US007306044B2

(12) United States Patent
Connell et al.

(10) Patent No.: US 7,306,044 B2
(45) Date of Patent: Dec. 11, 2007

(54) METHOD AND SYSTEM FOR LINING TUBULARS

(75) Inventors: Michael L. Connell, Duncan, OK (US); James C. Tucker, Springer, OK (US); Perry Courville, Houston, TX (US)

(73) Assignee: Halliburton Energy Services, Inc., Duncan, OK (US)

( * ) Notice: Subject to any disclaimer, the term of this patent is extended or adjusted under 35 U.S.C. 154(b) by 272 days.

(21) Appl. No.: 11/070,324

(22) Filed: Mar. 2, 2005

(65) Prior Publication Data

US 2006/0196678 A1 Sep. 7, 2006

(51) Int. Cl.
*E21B 43/10* (2006.01)

(52) U.S. Cl. ..... 166/380; 166/384; 166/207

(58) Field of Classification Search ..... 166/380, 166/384, 207, 277, 298, 55.8, 387, 383
See application file for complete search history.

(56) References Cited

U.S. PATENT DOCUMENTS 3,358,760 A * 12/1967 Blagg ..... 166/277
3,948,321 A * 4/1976 Owen et al. ..... 166/277
4,962,815 A 10/1990 Schultz et al.
5,234,053 A 8/1993 Connell
5,355,959 A 10/1994 Walter et al.
5,383,520 A 1/1995 Tucker et al.
5,404,955 A 4/1995 Echols, III et al.
5,435,395 A 7/1995 Connell
5,456,322 A 10/1995 Tucker et al.
5,485,745 A 1/1996 Rademaker et al.
5,507,349 A 4/1996 Wray et al.
5,626,192 A 5/1997 Connell et al.
5,704,393 A 1/1998 Connell et al.
5,762,142 A 6/1998 Connell et al.
5,832,998 A 11/1998 Decker et al.
5,845,711 A 12/1998 Connell et al.
5,988,277 A 11/1999 Vick, Jr. et al.
6,131,953 A 10/2000 Connell et al.
6,196,325 B1 3/2001 Connell et al.
6,220,360 B1 4/2001 Connell et al.
6,250,393 B1 6/2001 Mackenzie et al.
6,253,842 B1 7/2001 Connell et al.
6,305,467 B1 10/2001 Connell et al.
6,336,502 B1 1/2002 Surjaatmadja et al.
6,397,950 B1 6/2002 Streich et al.
6,467,546 B2 10/2002 Allamon et al.
6,668,930 B2 * 12/2003 Hoffman ..... 166/298
6,688,389 B2 2/2004 Connell et al.

(Continued)

OTHER PUBLICATIONS

Perry A. Fischer, "Expandables and the Dream of the Monodiameter Well: A Status Report," World Oil, Jul. 2004, pp. 63-64.

(Continued)

*Primary Examiner*—David Bagnell
*Assistant Examiner*—David Andrews
(74) *Attorney, Agent, or Firm*—John W. Wustenberg; Fish & Richardson P.C.

(57) ABSTRACT

A method for lining tubular includes positioning an expandable liner in a wellbore at a depth of one or more perforations using a downhole depth locator tool. The expandable liner is expanded in the wellbore to line the one or more perforations.

19 Claims, 4 Drawing Sheets

U.S. PATENT DOCUMENTS

| | | | | |
|---|---|---|---|---|
| 6,712,142 | B2 | 3/2004 | Simpson et al. | |
| 6,712,154 | B2 | 3/2004 | Cook et al. | |
| 6,719,061 | B2 | 4/2004 | Muller et al. | |
| 6,736,214 | B2 | 5/2004 | Hoffman et al. | |
| 6,766,853 | B2 | 7/2004 | Restarick et al. | |
| 7,108,061 | B2 * | 9/2006 | Cook et al. | 166/207 |
| 7,121,352 | B2 * | 10/2006 | Cook et al. | 166/387 |
| 2002/0079100 | A1 * | 6/2002 | Simpson et al. | 166/278 |
| 2003/0098154 | A1 | 5/2003 | Cook et al. | |
| 2003/0121669 | A1 | 7/2003 | Cook et al. | |
| 2004/0016544 | A1 | 1/2004 | Braddick | |
| 2007/0095532 | A1 * | 5/2007 | Head et al. | 166/277 |

OTHER PUBLICATIONS

Michael D. Bullock, "Advances Grow Expandable Applications," The American Oil & Gas Reporter, Sep. 2004 (4 pages).

Baker Hughes, "Guide to Successful Expandable Applications," Oilfield Completions Sourcebook, copyright 2003, BOT-03-4169 (2 pages).

Brochure, Enventure Global Technology, L.L.C., "SET™ Technology: The Facts," copyright 2004 (28 pages).

SPE 74834 paper entitled "New Downhole Tool Can Solve Depth Control Problems in Coiled-Tubing Fracturing" by M.L. Connell et al., dated 2002.

SPE 54327 paper entitled "Development of a Wireless Coiled Tubing Collar Locator" by Michael L. Connell et al., dated 1999.

SPE 60698 paper entitled "High-Pressure/High-Temperature Coiled Tubing Casing Collar Locator Provides Accurate Depth Control for Single-Trip Perforating" by Michael L. Connell et al., dated 2000.

* cited by examiner

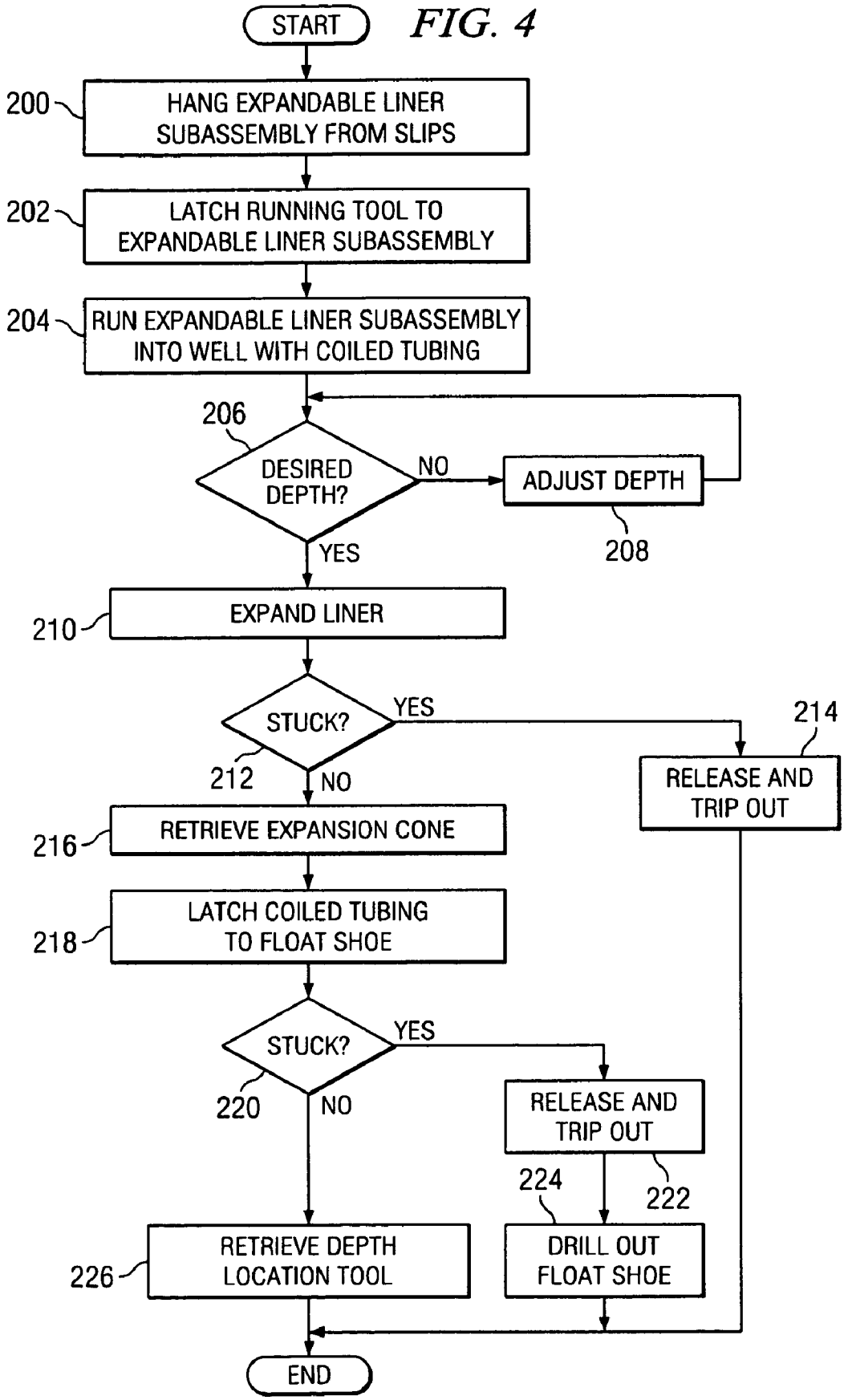
START
FIG. 4
200
HANG EXPANDABLE LINER SUBASSEMBLY FROM SLIPS
202
LATCH RUNNING TOOL TO EXPANDABLE LINER SUBASSEMBLY
204
RUN EXPANDABLE LINER SUBASSEMBLY INTO WELL WITH COILED TUBING
206
DESIRED DEPTH?
NO
ADJUST DEPTH
208
YES
210
EXPAND LINER
STUCK?
YES
214
212
NO
RELEASE AND TRIP OUT
216
RETRIEVE EXPANSION CONE
218
LATCH COILED TUBING TO FLOAT SHOE
STUCK?
YES
220
NO
RELEASE AND TRIP OUT
224
222
226
RETRIEVE DEPTH LOCATION TOOL
DRILL OUT FLOAT SHOE
END

METHOD AND SYSTEM FOR LINING TUBULARS

BACKGROUND

This disclosure relates generally to the field of downhole tools and operations, and more particularly to method and system for lining tubulars.

Oil and gas wells extend from the surface to one or more underground formations of rock containing oil and/or gas. The wellbore is typically cased to stabilize the sides of the well, to prevent pollution of fresh water reservoirs and to prevent fluids from zones other than the oil and gas producing zones from entering the well. Typically, the casing is cemented into the wellbore.

At the oil and gas production zones, the casing is perforated to allow oil, gas and/or by-products to enter the casing. Perforation is typically formed in the casings with shaped explosive charges or projectiles from a perforating gun. Fluids entering the casings through perforations are produced to the surface or otherwise processed. For example, water may be separated downhole and pumped into a disposal zone while oil and gas are produced to the surface.

After a production zone is depleted of oil and/or gas, perforations for the zone may be sealed to prevent water production into the casing from the depleted zone while production of oil and/or gas continues from other non-depleted zones. Perforations may be sealed using squeezed cement, straddle patch and chemical techniques. Straddle patch techniques typically use two packers at each end of a smaller section of tubing to straddle and pack-off perforations of the depleted zone. Chemical techniques typically squeeze chemical blends into the water producing perforations to seal-off the flow.

SUMMARY

A method and system for lining tubulars is provided. In accordance with one embodiment, a method for lining tubulars includes positioning an expandable liner in a wellbore at a depth of one or more perforations. The expandable liner is positioned at the depth of the one or more perforations using a downhole depth locator tool. The expandable liner is expanded in the wellbore to line the one or more perforations.

In accordance with one or more specific embodiments, the downhole depth locator tool may be retrieved from the wellbore after expansion of the expandable liner in the wellbore. The downhole depth locator tool may comprise a collar locator tool. In this and other embodiments, the downhole depth locator tool may be coupled to a float shoe having a fishing profile. The downhole depth locator tool may be retrieved from the wellbore by retrieving the float shoe with a running tool configured to connect with the fishing profile of the float shoe. The float shoe may comprise drillable material operable to be drilled out if the float shoe cannot be retrieved from the wellbore.

Technical advantages of one, some, all or none of the embodiments may include a method and system that more reliably and/or less expensively seals off or otherwise lines a tubular. For example, the method and system may be used in a wellbore to seal off water-producing or other formations intersected by the well. In the well embodiment, better depth control for sealing perforations may be provided through the use of a collar locator or other suitable depth locator tool. In addition, coiled tubing may be used to reduce rig requirements and reduce the required surface footprint. Accordingly, the method and system are well-suited to off-shore platforms as well as on-shore operations.

The details of one or more embodiments of the method and system for lining tubulars are set forth in the accompanying drawings and the description below. Other features, objects, and advantages of the method and system will be apparent from the description and drawings, and from the claims.

DESCRIPTION OF DRAWINGS

FIG. 4 is a flow diagram illustrating one embodiment of a method for lining tubulars using an expandable liner.

Like reference symbols in the various drawings indicate like elements.

DETAILED DESCRIPTION

Figure 1:
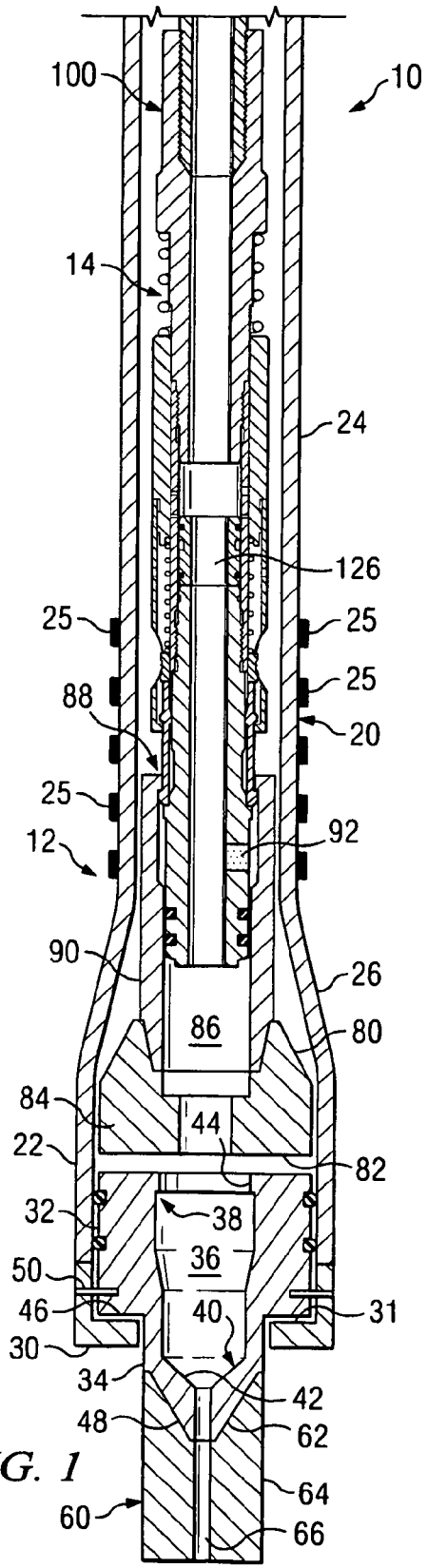
FIG. 1 is a cross-sectional view illustrating one embodiment of a tubular lining system.

FIG. 1 illustrates a tubular lining system 10 in accordance with one embodiment. The tubular lining system 10 lines a tubular by fitting a solid or other covering to an inside surface of the tubular. In this embodiment, the tubular lining system 10 comprises an expandable liner sub-assembly 12 and a running tool sub-assembly 14. The tubular lining system 10 may be used to seal off a water-producing or other zone in a cased wellbore by sealing perforations in the casing to the zone. The tubular lining system 10 may be used to otherwise seal at least a portion of a wellbore or other tubular. For example, the tubular lining system 10 may be used to seal any pipe including, for example, drill pipe, sectioned pipe, continuous pipe, casing, tubing, and flow lines. In this embodiment, the tubular lining system 10 comprises a tubular lining system. The tubular lining system 10 may also be used to otherwise line a tubular. For example, tubular lining system 10 may be used to screen an oil producing or other formation.

The expandable liner sub-assembly 12 comprises an expandable liner 20 and one or more tools for positioning and expanding the expandable liner 20. In a particular embodiment, the expandable liner 20 is an elongated substantially cylindrical (when expanded) liner having a pre-expanded portion 22, an unexpanded portion 24 and a connecting intermediate portion 26. The expandable liner 20 may comprise an alloy of steel or other suitable material to provide high strength and resistance to abrasion and fluid erosion. The expandable liner 20 may comprise a solid liner, a permeable liner such as a perforated liner or screen, or other covering.

One or more bands 25 may be provided on a periphery of the expandable liner 20 at its top and/or bottom. The bands may, upon expansion of the expandable liner 20, form a seal and/or friction fit between the expandable liner 20 and the tubular being lined. The bands 25 may be disposed on the unexpanded portion 24 and/or intermediate portion 26 at the bottom of the expandable liner 20 and on the unexpanded portion 24 at the top of the expandable liner 20. The bands 25 may comprise rubber or other suitable material. The expandable liner 20 may be otherwise secured within the tubular being lined.

A float collar 30 may be provided at the bottom end of the expandable liner 20. The float collar 30 may be welded, threaded to, integral with or otherwise coupled to the expandable liner 20. The float collar 30 may have a seat 31 with an internal diameter (ID) reduced from that of the pre-expanded portion 22 of the expandable liner 20 to seat, hold or otherwise secure float shoe 32. The float collar 30 may comprise the same material as the expandable liner 20 or other suitable material. In one embodiment, for example, the float collar 30 may comprise a drillable material such as brass, cast iron, aluminum and or composite.

The float shoe 32 is disposed in and retrievable from the expandable liner 20. The float shoe 32 may comprise a cylindrical body 34 defining an interior passageway 36. The interior passageway 36 may comprise a fishing profile 38, a throat 40 and a ball seat 42. The fishing profile 38 may be internal to the float shoe 32, external or otherwise. The fishing profile 38 may be a fishneck or other suitable profile for coupling with the running tool sub-assembly 14 or other tool downhole. In the illustrated embodiment, the fishing profile 38 comprises a fishneck having a lip 44 with a reduced ID.

A seat 46 and threads 48 may be formed on an exterior of the cylindrical body 34. The seat 46 may be configured to rest on the float collar 30. In one embodiment, the fishing profile 38 of the float shoe 32 is exposed above the float collar 30 with the threads 48 exposed below the float collar 30 when the seat 46 of the float shoe 32 is resting on or secured to the float collar 30. The float shoe 32 may be releasably secured to the float collar 30 through one or more shear pins 50. The shear pins 50 may comprise pins, screws, or other shearable fasteners. The float shoe 32 may be otherwise secured or may not be secured to the float collar 30. The float shoe 32 may comprise drillable or other suitable material.

A downhole depth locator tool 60 may be attached, suspended or otherwise coupled to the lower end of the float shoe 32. In the embodiment in which the float shoe 32 comprises external threads 48, the downhole depth locator tool 60 may comprise corresponding internal threads 62. The downhole depth locator tool 60 may be otherwise suitably coupled to the float shoe 32.

The downhole depth locator tool 60 is configured for downhole or in pipe operations. The downhole depth locator tool 60 may comprise a cylindrical body 64 defining an interior passageway 66 to allow circulation through the downhole depth locator tool 60. The interior passageway 66 may comprise a check or other suitable valve to control circulation through the downhole depth locator tool 60. In other embodiments, the interior passageway 66 may be omitted with circulation otherwise established or omitted.

The downhole depth locator tool 60 provides depth correlation for accurately positioning the tubular lining system 10 in a wellbore or other pipe. Depth correlation may be any suitable correlation of distance traveled or position. Thus, the depth correlation may comprise correlation in vertical, horizontal or other tubing.

In a particular embodiment, the downhole depth locator tool 60 may comprise a collar locator tool that logs casing collars for depth correlation. The collar locator tool may, for example, locate casing collars in the wellbore and correlate those depths back to the original case hole logs. In a particular embodiment, the collar locator tool may comprise a DEPTHPRO collar locator tool. The downhole depth locator tool 60 may be fully downhole or have a portion, for example, a receiver, at the surface or elsewhere. In another embodiment, for example, the downhole depth locator tool 60 may comprise a gamma ray tool operable to log strata which may be correlated back to original logs.

An expansion cone, or pig, 80 may be disposed in the expandable liner 20 above the float shoe 32. In one embodiment, the expansion cone 80 is disposed immediately above the float shoe 32. The expansion cone 80 expands the expandable liner 20 as it is drawn through or retrieved from the expandable liner 20.

In one embodiment, the expansion cone 80 comprises a cylindrical body 84 defining an interior passageway 86. The interior passageway 86 may comprise a seal bore. The cylindrical body 84 includes one or more exterior conical surfaces for engaging the ID of the expandable liner 20. Thus, axial movement of the expansion cone 80 radially expands the expandable liner 20. As described in more detail below, a combination of tension applied by coiled tubing pulled from the surface and pressurized fluid acting on a base 82 of the expansion cone 80 may cause the expansion cone 80 to move upwardly and expand the expandable liner 20 as it travels. In an embodiment in which the expandable liner 20 comprises a screen or is otherwise permeable, the permeable area may begin above the bands 25 to allow pressure to expand the banded area and/or to start the expansion cone 80 moving.

A fishing profile 88 may be provided at an upper end of the expansion cone 80. The fishing profile 88 may be integral with the expansion cone 80 or formed in a fishneck 90 threaded or otherwise coupled to the expansion cone 80. The expansion cone 80 and/or fishneck 90 may comprise a steel alloy, drillable or other suitable material.

The expandable liner sub-assembly 12 may be otherwise suitably configured and implemented. For example, the float shoe 32 may be attached or otherwise coupled to the expansion cone 80 to allow the downhole depth locator tool 60 to be retrieved with the expansion cone 80 as the expandable liner 20 is expanded. In another embodiment, the float shoe 32 may be omitted and the downhole depth locator tool 60 connected directly or otherwise to the expansion cone 80 to allow retrieval with the expansion cone 80. In addition, the downhole depth locator tool 60 may be omitted in some embodiments. In these embodiments, the expandable liner 20 may be expanded solely by tension applied by coiled or other tubing pulling from the surface and/or by otherwise biasing the expansion cone 80 upwardly.

The running tool sub-assembly 14 comprises tools to convey the expandable liner sub-assembly 12 into a wellbore or other pipe. The running tool sub-assembly 14 may also be used in connection with the lining operation and to recover tools from the wellbore after the lining operation. In one embodiment, the running tool sub-assembly 14 comprises a running/pulling tool 100 configured to latch into the fishneck 90 of the expansion cone 80. The running/pulling tool 100 may comprise a running tool or a combined running and pulling tool. The running/pulling tool 100 may also be configured to latch into the fishing profile 38 of the float shoe 32 for retrieving the float shoe 32 and attached downhole depth locator tool 60. In a particular embodiment, described in more detail below, the running/pulling tool 100 comprises dogs that engage the fishneck 90 of the expansion cone 80 and the fishing profile 38 of the float shoe 32. A lower end of the running/pulling tool 100 may include a seal mandrel that seals into the seal bore of the expansion cone 80. The running/pulling tool 100 may also include a rupture disk 92 to re-establish flow and allow release of the running/pulling tool 100 if the expansion cone 80 becomes wedged, caught or otherwise stuck during the lining process. In another embodiment, the rupture disk 92 may be elsewhere when located—for example, the rupture disk 92 may be formed in fishneck 90 and/or expansion cone 80.

The running tool sub-assembly 14 may be connected to coiled, sectioned or other suitable tubing. In the coiled tubing embodiment, the running tool sub-assembly 14 may include a coiled tubing motor head for attachment of the coiled tubing to the running/pulling tool 100. The motor head may have a flapper check valve for well control and a hydraulic or other disconnect for emergency release. A circulating sub and rupture disk may be built into the coiled tubing motor head for contingency circulation. A fluted centralizer may be run below the motor head and above the running tool sub-assembly 14 to centralize the running/pulling tool 100 inside the expandable liner 20.

In operation, as described in more detail below, the expandable liner sub-assembly 12 is run into a wellbore or other tubular using the running tool sub-assembly 14. Once the expandable liner sub-assembly 12 is in the area to be clad, the downhole depth locator tool 60 is used to log casing collars for depth correlation and any necessary depth adjustments are made. When the expandable liner sub-assembly 12 is located at the proper depth, a ball is landed on seat 42 and pressure is applied through the coiled tubing and acts on the base 82 of the expansion cone 80 to move the expansion cone 80 upwardly and radially expand the expandable liner 20 into intimate or other suitable contact with a casing of the wellbore. In the illustrated embodiment, the expandable liner is expanded to put the bands 25 into sealing contact with the casing. The coiled tubing pulls on the expansion cone 80 as it expands the expandable liner 20.

After the expansion process is completed, the coiled tubing is tripped from the wellbore to recover the expansion cone 80. At the surface, a jar and accelerator are installed above the running/pulling tool 100 and the running tool sub-assembly 14 is tripped back into the wellbore to retrieve the float shoe 32 and attached downhole depth locator tool 60. The running/pulling tool 100 latches into the fishing profile 38 of the float shoe 32 and jarring shears the shear pins 50 in the float shoe 32. The float shoe 32 and downhole depth locator tool 60 are retrieved to the surface and recovered. The running/pulling tool 100 may be the same or different than that used to latch into the expansion cone 80.

If the expansion cone 80 becomes stuck in the expandable liner 20 during the lining process, the running tool sub-assembly 14 may be disconnected from the expansion cone 80 by re-establishing circulation and retracting the latching dogs of the running/pulling tool 100. Circulation may be re-established and latching dogs retracted by, for example, rupturing rupture disk 92 to re-establish circulation and dropping a ball to move a sleeve and uncover ports to retract the latching dogs. If the float shoe 32 cannot be retrieved after expansion of the expandable liner 20, the float shoe 32 may be drilled out far enough to allow it to fall off the end of the expandable liner 20. The remainder of the float shoe 32 and downhole depth locator tool 60 may thereafter be pushed to a sump and/or further fishing operations may take place.

Figure 2:
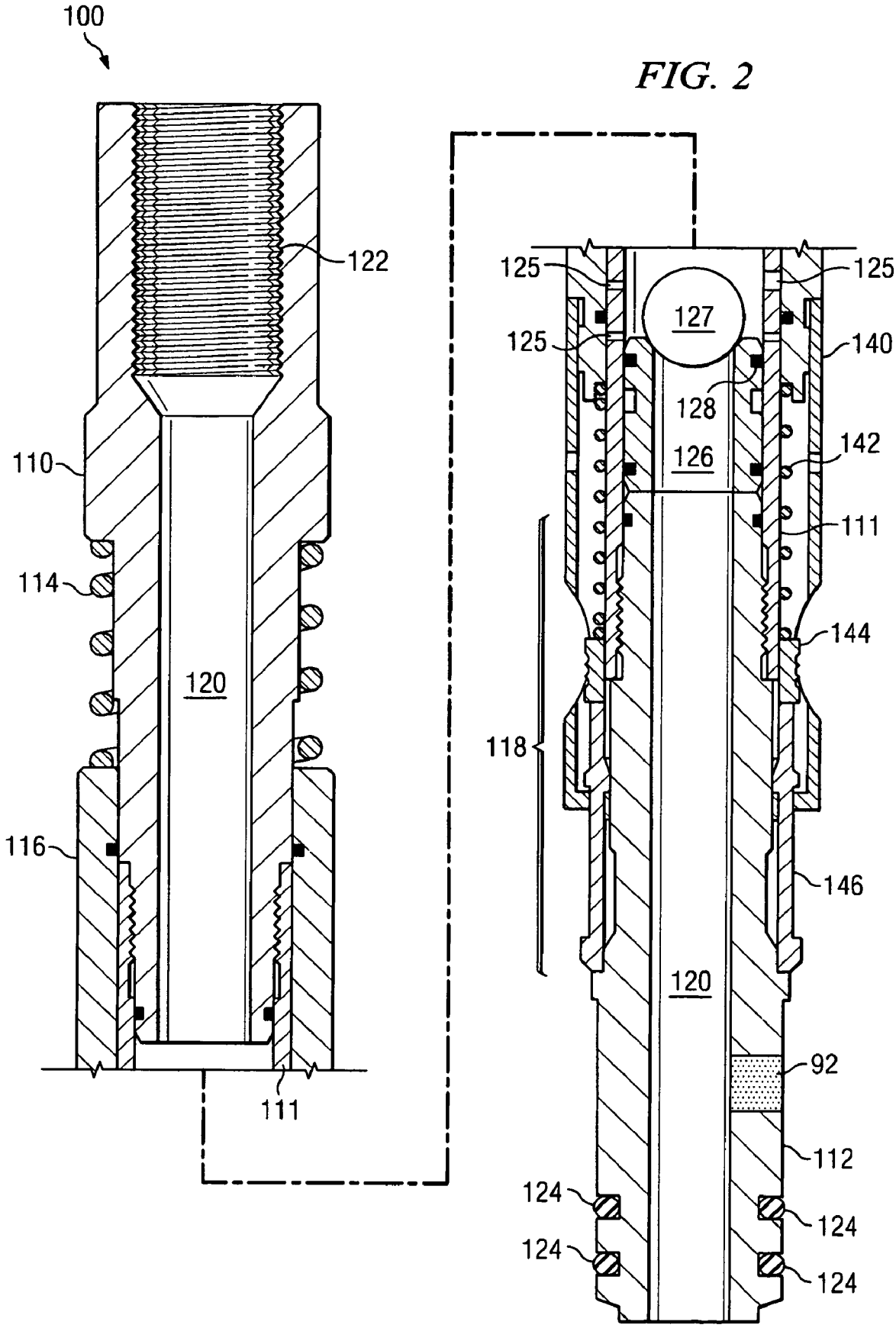
FIG. 2 is a cross-sectional view of the running/pulling tool of FIG. 1.

FIG. 2 illustrates details of the running/pulling tool 100 in one embodiment. In this embodiment, the running/pulling tool 100 comprises an upper sub-assembly 110, intermediate section 111, seal mandrel 112, spring 114, piston 116 and dog sub-assembly 118. The running/pulling tool 100 may be substantially cylindrical and include an interior passageway 120. The running/pulling tool 100 may be made of one or more steel alloys or other suitable materials.

The upper sub-assembly 110 may comprise interior box threads 122 at an upper end for connection to the coiled tubing motor head, drill pipe or other tubular operable to convey the running/pulling tool 100 into a wellbore or other tubular. The upper sub-assembly 110 is threadably or otherwise suitably connected at its lower end to an upper end of the intermediate section 111 which is threadably or otherwise suitably connected at its rear end to an upper end of the intermediate section 111 which is threadably or otherwise suitably connected at the lower end to an upper end of the seal mandrel 112.

The seal mandrel 112 includes one or more seals 124 at its lower end for sealably connecting with the expansion cone 80 and/or float shoe 32. In one embodiment, the seals 124 may comprise a plurality of o-rings. In this embodiment, the o-rings may comprise one or more of a variety of rubber compounds. In another embodiment, the seals 124 may be, for example, chevron packing.

The seal mandrel 112 also includes ports 125 and sleeve 126 with seals 128. The sleeve 126 may be pinned in place with one or more shear pins and moved in the interior passageway 120 to uncover ports 125 and allow the dog sub-assembly 118 to retract. In this embodiment, the sleeve 126 may travel in the interior passageway 120 until contact with the upper end of seal mandrel 112. The sleeve 126 may be moved in the interior passageway 120 by circulating a ball 127 or otherwise.

Spring 114 biases piston 116 downwardly toward the dog sub-assembly 118 to bias the dog sub-assembly 118 in the latched position. The dog sub-assembly 118 may comprise a cylinder 140, spring 142, dog retainer 144 and latching dogs 146. The latching dogs 146 may allow the running/pulling tool 100 to latch with a relatively low compression force and to pull with a relatively high tension force while still allowing selective retraction of the running/pulling tool 100 downhole.

In operation, the running/pulling tool 100 latches into the expandable liner sub-assembly 12 and is used in connection with coiled tubing to convey the expandable liner sub-assembly 12 downhole. During expansion of the expandable liner 20, running/pulling tool 100 pulls expansion cone 80 through the expandable liner 20 as the expansion cone 80 is pushed at its bore 82 by pressure after the expansion cone 80 exits the top of the expandable liner 20, the running/pulling tool 100 pulls the expansion cone 80 out of the wellbore. Thereafter, the running/pulling tool 100 may be tripped back into the wellbore to retrieve the float shoe 32 and attached downhole depth locator tool 60.

Figure 3A:
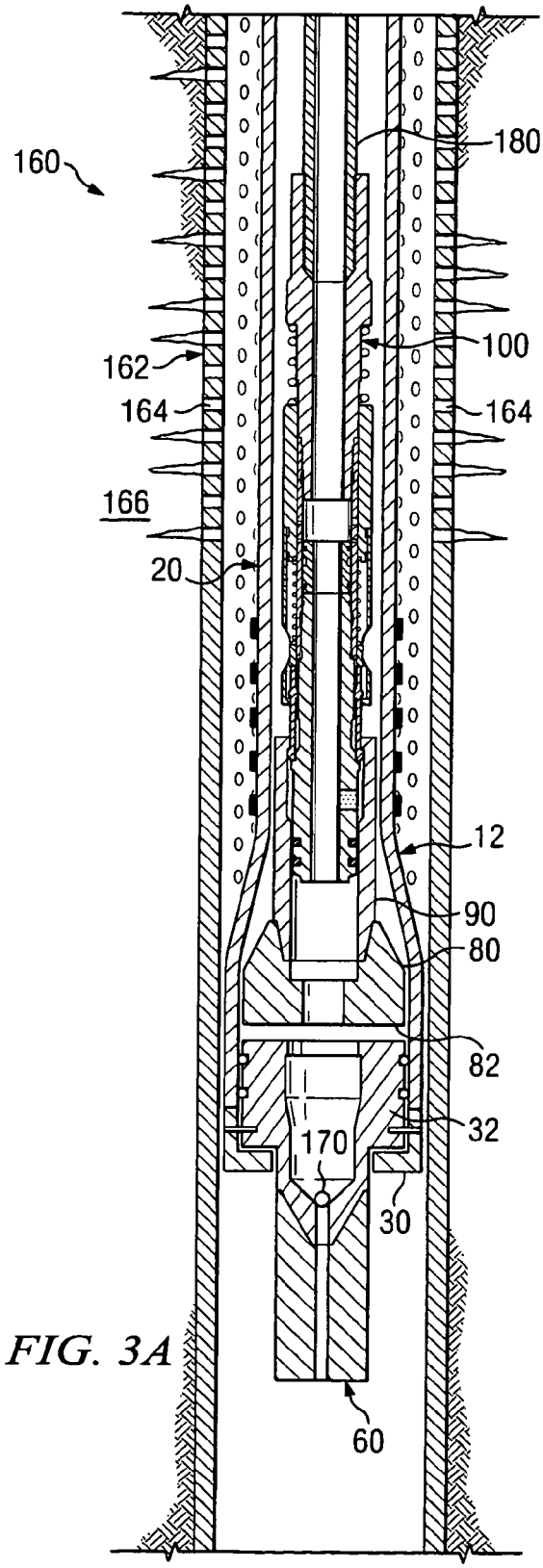
FIGS. 3A-C are cross-sectional views, not necessarily the scale, illustrating one embodiment of use of the tubular lining system of FIG. 1.
Figure 3B:
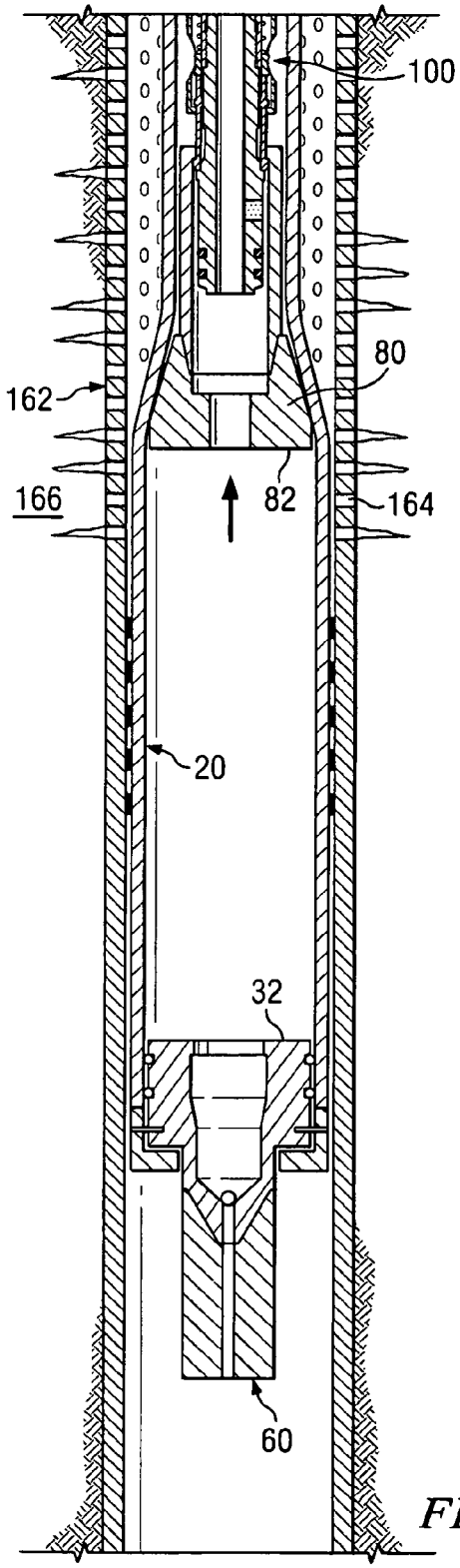
Figure 3C:
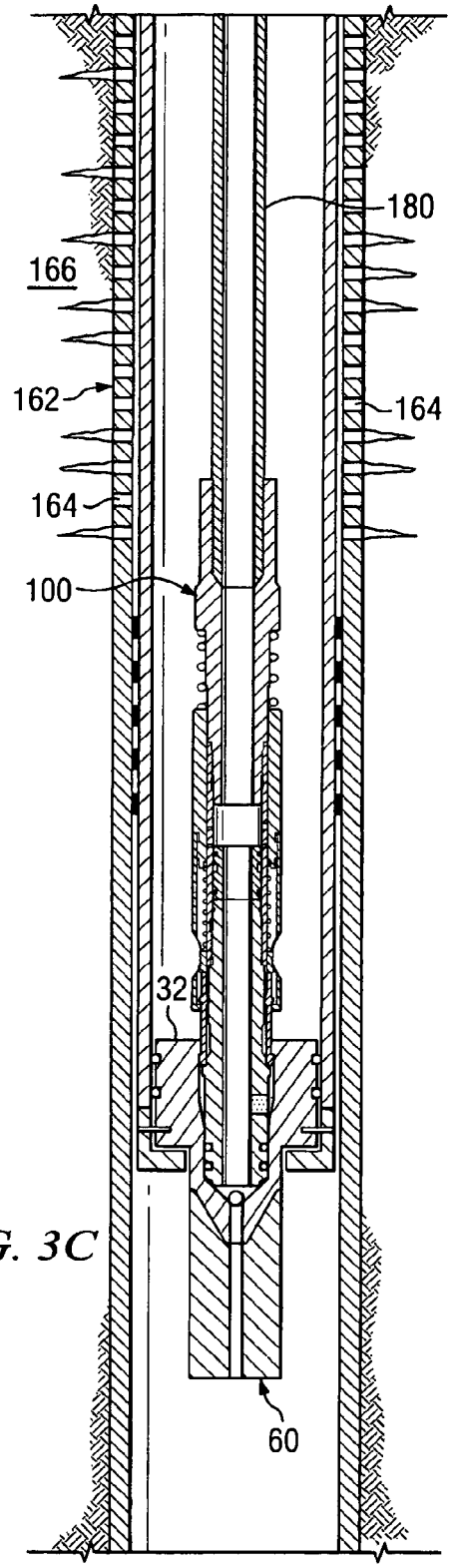

FIGS. 3A-C illustrate use of the tubular lining system 10 in a wellbore 160 having a casing 162 to seal existing perforations 164 to a water or other producing zone 166. In this embodiment, the expandable liner 20 comprises a solid liner. As previously described, the tubular lining system 10 may be used to clad or line other suitable types of tubulars.

Referring to FIG. 3A, the expandable liner sub-assembly 12 of the tubular lining system 10 is positioned in the wellbore 160 with the running tool sub-assembly 14. In one embodiment, the expansion cone 80 and the float shoe 32 are loaded into the pre-expanded portion 22 of the expandable liner 20. The float collar 30 is connected to a lowest joint of the expandable liner 20. The float shoe 32 is pinned in place with shear pins 50. The downhole depth locator tool 60 is fitted with batteries, started and then threaded onto the lower end of the float shoe 32. This assembly along with other joints of the expandable liner 20 are made up and hung on slips of a rig or coiled tubing unit for the wellbore 160 at the surface.

The running tool sub-assembly 14 may, in the coiled tubing embodiment, be made up by installing the coiled tubing motor head at a lower end of coiled tubing 180 and the running/pulling tool 100 attached to the motor head. The coiled tubing 180 is lowered through the expandable liner 20 and latched into the fishneck 90 of the expansion cone 80. The surface slips may thereafter be removed and the entire tubular lining system 10 run into the wellbore 160.

When the expandable liner sub-assembly 12 is in the area of the perforations 164, to be clad, the downhole depth locator tool 60 may be used to log casing collars for depth correlation and any necessary depth adjustments made. The depth correlation may be performed while the expandable liner sub-assembly 12 is moving or otherwise while running the expandable liner sub-assembly 12 into the wellbore 160. When the expandable liner sub-assembly 12 is located at the proper depth such that the expandable liner 20 will cover and/or seal the perforations 164, a ball 170 is circulated through the coiled tubing 180 and the running/pulling tool 100 to seat in the ball seat 42 of the float shoe 32. The ball 170 seals off the float path to the downhole depth locator tool 60 and allows pressure to build inside the expandable liner 20. Fluid is pumped downhole through the coiled tubing 180 at pressure which builds inside the expandable liner 20 at the base 82 of the expansion cone 80.

Referring to FIG. 3B, the pressurized fluid acts on the base 82 of the expansion cone 80 to axially move the expansion cone 80 upward to radially expand the expansion liner 20 to clad the casing 162 and seal perforations 164. Tension is applied to the expansion cone 80 by the coiled tubing 180 while the pressurized fluid acts on the base 82 of the expansion cone 80. The running/pulling tool 100 pulls the expansion cone 80 out of the expandable liner 20 as the expandable liner 20 is expanded. After the expansion process is completed, the coiled tubing 180 is tripped from the wellbore 160 to retrieve the expansion cone 80. At the surface, a jar and accelerator may be installed above the running/pulling tool 100 and the running/pulling tool 100 tripped back into the wellbore 160 to retrieve the float shoe 32 and the attached downhole depth locator tool 60.

Referring to FIG. 3C, the running/pulling tool 100 is latched into the fishing profile 38 of the float shoe 32. Upon latching with the latching dogs 146 or other suitable mechanism, shear pins 50 are sheared and the coiled tubing 180 tripped to the surface to retrieve the float shoe 32 and downhole depth locator tool 60.

As previously described, if the expansion cone 80 becomes stuck in the expandable liner 20 during the lining process, the running/pulling tool 100 may be released from the expansion cone 80. In one embodiment, the running/pulling tool 100 may be released by bursting the rupture disk 92 to establish circulation and circulating a ball to seat on sleeve 126 and move sleeve 126 to uncover ports 125 to allow the latching dogs 146 to retract. Once the latching dogs 146 retract, the running/pulling tool 100 can be removed from the wellbore 160.

If the float shoe 32 cannot be retrieved after expansion of the expandable liner 20, the float shoe 32 can be drilled out. When the float shoe 32 is drilled out far enough to allow it to fall off the end of the expanded expandable liner 20, the float shoe 32 and downhole depth locator tool 60 can be pushed to a sump of the wellbore 160 or further fishing operations can take place in the wellbore 160.

FIG. 4 illustrates one embodiment of a method for lining tubulars. In this embodiment, a casing 162 of a wellbore 160 is cladded with an expandable liner 20 that is solid. Other types of tubular may be suitably cladded or lined without departing from the scope of the disclosure.

Referring to FIG. 4, the method begins at step 200 in which the expandable liner sub-assembly 12 is hung from slips at the surface. At step 202, the running/pulling tool 100 is latched to the expandable liner sub-assembly 12. At step 204, the expandable liner sub-assembly 12 is run into the wellbore 160 with the running/pulling tool 100 on the end of coiled tubing 180.

Next, at decisional step 206, it is determined if the expandable liner sub-assembly 12 is positioned at a desired depth. As previously described, the downhole depth locator tool 60 may be used for depth correlation. If the expandable liner sub-assembly 12 is not at the desired depth, the No branch of step 206 leads to step 208 where the depth is adjusted. Step 208 returns to step 206. When the expandable liner sub-assembly 12 is positioned at the desired depth, the Yes branch of decisional step 206 leads to step 210. At step 210, the expandable liner 20 is expanded using the combination of tension applied by the coiled tubing 180 and pressurized fluid acting on the base 82 of the expansion cone 80. The pressure is applied to the base 82, in one embodiment, by dropping the ball 170. The expandable liner 20 is expanded to seal or otherwise clad the casing 162 and/or perforations 164 of the wellbore 160. The casing 162 and perforation 164 may be sealed when inflow of fluids through the casing 162 and/or perforation 164 into production stream of the wellbore 160 is completely or at least substantially stopped.

Proceeding to the decisional step 212, if the expansion cone 80 becomes stuck during the expansion process, the Yes branch of decisional step 212 leads to step 214. At step 214, the running/pulling tool 100 is retracted to release the expansion cone 80 and allow the coiled tubing 180 to be tripped out of the hole. Step 214 leads to the end of the process. Additional fishing/recovery operations may be performed.

Returning to decisional step 212, if the expansion cone 80 does not become stuck during the expansion process, the No branch of step 212 leads to step 216 in which the expansion cone 80 is pulled through the entirety of the expandable liner 20 and retrieved at the surface by tripping the coiled tubing 180 out of the wellbore 160.

At step 218, the running/pulling tool 100 is tripped back into the wellbore 160 and latched to the float shoe 32. At decisional step 220, if the float shoe 32 is stuck, the Yes branch leads to step 222. At step 222, the running/pulling tool 100 is released from the float shoe 32 and tripped out of the wellbore 160. At step 224, the float shoe 32 may be drilled out to allow it and the downhole depth locator tool 60 to fall to the bottom of the wellbore 160.

Returning to decisional step 220, if the float shoe 32 is not stuck, the No branch leads to step 226. At step 226, the coiled tubing 180 is tripped out of the wellbore 160 to retrieve the downhole depth locator tool 60. Step 226 leads to the end of the process.

A number of embodiments of the invention have been described. Nevertheless, it will be understood that various modifications may be made without departing from the spirit and scope of the invention. Accordingly, other embodiments are within the scope of the following claims.

What is claimed is:

1. A method for lining tubulars, comprising:

positioning an expandable liner in a well bore at a depth of one or more perforations using a down-hole depth locator tool;

expanding the expandable liner in the well bore to line the one or more perforations; and the down-hole depth locator tool coupled to a float shoe having a fishing profile and retrieving the down-hole depth locator tool by retrieving the float shoe with a running tool configured to connect with the fishing profile.

2. The method of claim 1, wherein the down-hole depth locator tool comprises at least one of a collar locator tool and gamma ray tool.

3. The method of claim 1, wherein the expandable liner, upon expansion seals the one or more perforations.

4. The method of claim 1, further comprising retrieving the down-hole depth locator tool from the well bore after expansion of the expandable liner in the well bore.

5. The method of claim 1, further comprising drilling out the float shoe if the float shoe cannot be retrieved from the well bore.

6. The method of claim 1, further comprising:

expanding the liner with an expansion cone coupled to the running tool;

releasing the running tool if the expansion cone becomes stuck in the well bore; and retrieving the running tool.

7. The method of claim 1, further comprising:

expanding the expandable liner by sealing a float shoe located beneath an expansion cone disposed in the expandable liner; and applying pressure through a coiled tubing coupled to the expansion cone to push the expansion cone upwardly through the expandable liner.

8. An expandable liner sub-assembly, comprising:

an expandable liner; and a down-hole depth locator tool for positioning the expandable liner in a well bore, wherein the down-hole depth locator tool is retrievable from the well bore and wherein the down-hole depth locator tool is retrievable from the expandable liner via a float shoe.

9. The expandable liner sub-assembly of claim 8, wherein the float shoe is disposed in and retrievable from the expandable liner.

10. The expandable liner sub-assembly of claim 8, wherein the float shoe comprises a fishing profile for retrieval of the float shoe.

11. The expandable liner sub-assembly of claim 8, wherein the float shoe comprises a drillable material.

12. The expandable liner sub-assembly of claim 8, further comprising:

an expansion cone disposed in the expandable liner above the down-hole depth locator tool; and the expansion cone operable to expand the expandable liner.

13. The expandable liner sub-assembly of claim 12, the expansion cone releasably connected to tubing, the tubing operable to retrieve the expansion cone from the well bore.

14. The expandable liner sub-assembly of claim 13, further comprising:

the expansion cone comprising a fishing profile for connection to a running tool;

a rupture disk to establish circulation if the expansion cone becomes stuck in the expandable liner; and wherein circulation releases the running tool from the expansion cone.

15. The expandable liner sub-assembly of claim 14, further comprising seals for sealing a connection between the running tool and the expansion cone.

16. A method for cladding tubulars, comprising:

positioning, with a running tool comprising a seal mandrel and a down-hole depth locator tool coupled to a float shoe having a fishing profile, an expandable liner in a tubular at a depth of one or more perforations, the seal mandrel sealing with an expansion cone;

expanding the expandable liner in the tubular by applying pressure to a base of the expansion cone to seal the one or more perforations; and retrieving the down-hole depth locator tool by retrieving the float shoe with a running tool configured to connect with the fishing profile.

17. The method of claim 16, further comprising positioning the expandable liner at the depth of the one or more perforations using a down-hole depth locator tool.

18. The method of claim 16, further comprising retrieving down-hole depth locator tool from the tubular after expansion of the expandable liner in the well bore.

19. The method of claim 17, wherein the down-hole depth locator tool comprises a collar locator tool.

* * * * *